US006110636A

United States Patent [19]

Foucher et al.

[11] Patent Number: 6,110,636

[45] Date of Patent: Aug. 29, 2000

[54] POLYELECTROLYTE TONER PROCESSES

[75] Inventors: Daniel A. Foucher, Toronto; Walter Mychajlowskij, Mississauga; Guerino G. Sacripante; Raj D. Patel, both of Oakville, all of Canada

[73] Assignee: Xerox Corporation, Stamford, Conn.

[21] Appl. No.: 09/182,107

[22] Filed: Oct. 29, 1998

[51] Int. Cl.[7] ..... G03G 9/08

[52] U.S. Cl. ..... 430/137; 523/335

[58] Field of Search ..... 430/137; 523/335

[56] References Cited

U.S. PATENT DOCUMENTS

| | | | |
|---|---|---|---|
| 3,590,000 | 6/1971 | Palermiti et al. | 252/62.1 P |
| 3,720,617 | 3/1973 | Chatterji et al. | 252/62.1 |
| 3,957,912 | 5/1976 | Cincera | 523/335 |
| 4,558,108 | 12/1985 | Alexandru et al. | 526/340 |
| 4,560,635 | 12/1985 | Hoffend et al. | 430/106.6 |
| 4,797,339 | 1/1989 | Maruyama et al. | 430/109 |
| 4,935,326 | 6/1990 | Creatura et al. | 430/108 |
| 4,937,166 | 6/1990 | Creatura et al. | 430/108 |
| 4,983,488 | 1/1991 | Tan et al. | 430/137 |
| 4,996,127 | 2/1991 | Hasegawa et al. | 430/109 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,348,832 | 9/1994 | Sacripante et al. | 430/109 |
| 5,364,729 | 11/1994 | Kmiecik-Lawrynowicz et al. | 430/137 |
| 5,366,841 | 11/1994 | Patel | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et al. | 430/137 |
| 5,585,215 | 12/1996 | Ong et al. | 430/137 |
| 5,593,807 | 1/1997 | Sacripante et al. | 430/137 |
| 5,648,193 | 7/1997 | Patel et al. | 430/137 |
| 5,650,255 | 7/1997 | Ng et al. | 430/137 |
| 5,650,256 | 7/1997 | Veregin et al. | 430/137 |
| 5,658,704 | 8/1997 | Patel et al. | 430/137 |
| 5,766,818 | 6/1998 | Smith et al. | 430/137 |
| 5,916,725 | 6/1999 | Patel et al. | 430/137 |

FOREIGN PATENT DOCUMENTS

93/12183 6/1993 WIPO .

OTHER PUBLICATIONS

Kirk–Othmer Concise Encyclopedia of Chemical Technology. New York: John Wiley & Sons. pp. 492–494, 923, and 924, 1985.

Grant and Hackh's Chemical Dictionary. New York: McGraw–Hill, Inc. p. 461, 1987.

*Primary Examiner*—Christopher D. Rodee

*Attorney, Agent, or Firm*—E. O. Palazzo

[57] ABSTRACT

A surfactant free process for the preparation of toner comprising heating a mixture of an emulsion latex, a colorant, and a polyelectrolyte.

28 Claims, No Drawings

POLYELECTROLYTE TONER PROCESSES

PENDING APPLICATIONS AND PATENTS

The appropriate components and processes of the following copending applications and patents may be selected for the present invention in embodiments.

U.S. Pat. No. 5,840,462 discloses a toner process wherein a colorant is flushed into a sulfonated polyester, followed by the addition of an organic soluble dye and an alkali halide solution.

U.S. Pat. No. 5,853,944 discloses a toner process with a first aggregation of sulfonated polyester, and thereafter, a second aggregation with a colorant dispersion and an alkali halide.

U.S. Pat. No. 5,916,725 discloses a toner process wherein there is mixed an emulsion latex and colorant dispersion, and wherein the colorant dispersion is stabilized with submicron sodio sulfonated polyester resin particles, and wherein the latex resin can be a sodio sulfonated polyester.

Also, illustrated in U.S. Pat. No. 5,944,650 and U.S. Pat. No. 5,766,818, the disclosures of which are totally incorporated herein by reference, are cleavable surfactants and the use thereof in emulsion/aggregation/coalescence processes.

In U.S. Pat. No. 5,853,944 there are illustrated emulsion/aggregation toner processes wherein there are selected, for example, dicationic salts, or diamines, which can result in unsuitable crosslinking interactions between the latex resin, especially a sulfonated polyester, a disadvantage avoided with the present invention.

Illustrated in U.S. Pat. No. 5,658,704, the disclosure of which is totally incorporated herein by reference, is a process for the preparation of toner comprised of i) flushing pigment into a sulfonated polyester resin, and which resin has a degree of sulfonation of from between about 0.5 and about 2.5 mol percent based on the repeat unit of the polymer;

ii) dispersing the resulting pigmented sulfonated polyester resin in warm water, which water is at a temperature of from about 40 to about 95° C., and which dispersing is accomplished by a high speed shearing polytron device operating at speeds of from about 100 to about 5,000 revolutions per minute thereby enabling the formation of toner sized particles, and which particles are of a volume average diameter of from about 3 to about 10 microns with a narrow GSD;

iii) recovering the toner by filtration;

iv) drying the toner by vacuum; and v) optionally adding to the dry toner charge additives and flow aids.

Illustrated in U.S. Pat. No. 5,648,193, the disclosure of which is totally incorporated herein by reference, is a process for the preparation of toner compositions comprised of (i) flushing pigment into a sulfonated polyester resin, and which resin has a degree of sulfonation of from between about 2.5 and 20 mol percent based on the repeat unit of the polymer; (ii) dissipation of the resulting pigmented sulfonated polyester in water at about 40 to about 75° C. to obtain particles which are in the size range of about 50 to 200 nanometers; (iii) followed by cooling the resulting mixture below about the glass transition temperature of the sulfonated polyester; and adding, dropwise, a metal salt halide such as a magnesium chloride solution to form particles of a volume average diameter of from about 3 to about 10 microns with a narrow GSD; (iv) recovering the toner particles by filtration; (v) drying the toner particles by vacuum; and (vi) optionally adding to the dry toner particles charge additives and flow aids.

BACKGROUND OF THE INVENTION

The present invention is generally directed to toner processes, and more specifically, to surfactant free aggregation and coalescence processes for the preparation of toner compositions. In embodiments, the present invention is directed to the economical chemical in situ chemical preparation of toners without the utilization of known pulverization and/or classification methods, and wherein in embodiments toner compositions with a volume average diameter of from about 1 to about 25, preferably about 1 to about 10, or from about 3 to about 9 microns, and narrow GSD of, for example, from about 1.14 to about 1.25 as measured on the Coulter Counter can be obtained, and wherein there are selected for these processes polyelectrolytes. The resulting toners can be selected for known electrophotographic imaging, digital, printing processes, including color processes, and lithography. The aforementioned toners are especially useful for the development of colored images with excellent line and solid resolution, and wherein substantially no background deposits are present.

In reprographic technologies, such as xerographic and ionographic devices, toners with volume average diameter particle sizes of from about 9 microns to about 20 microns are effectively utilized. Moreover, in xerographic technologies, such as the high volume Xerox Corporation 5090 copier-duplicator, high resolution characteristics and low image noise are highly desired, and can be attained utilizing the small sized toners of the present invention with, for example, a volume average particle diameter of from about 2 to about 11 microns and preferably less than about 7 microns, and with a narrow geometric size distribution (GSD) of from about 1.16 to about 1.3. Additionally, in xerographic systems wherein process color is utilized, such as pictorial color applications, small particle size colored toners, preferably of from about 3 to about 9 microns, are desired to avoid, or minimize paper curling. Also, it is preferable to select small toner particle sizes, such as from about 1 to about 7 microns, and with higher colorant loading, such as from about 5 to about 12 percent by weight of toner, such that the mass of toner layers deposited onto paper is reduced to obtain the same quality of image and resulting in a thinner plastic toner layer on paper after fusing, thereby minimizing or avoiding paper curling. Toners prepared in accordance with the present invention enable in embodiments the use of lower image fusing temperatures, such as from about 120° C. to about 150° C., thereby avoiding or minimizing paper curl. Lower fusing temperatures minimize the loss of moisture from paper, thereby reducing or eliminating paper curl. Furthermore, in process color applications, and especially in pictorial color applications, toner to paper gloss matching is highly desirable. Gloss matching is referred to as matching the gloss of the toner image to the gloss of the paper. For example, when a low gloss image of preferably from about 1 to about 30 gloss is desired, low gloss paper is utilized, such as from about 1 to about 30 gloss units as measured by the Gardner Gloss metering unit, and which after image formation with small particle size toners, preferably for example, of from about 3 to about 5 microns and fixing thereafter, results in a low gloss toner image of from about 1 to about 30 gloss units as measured by the Gardner Gloss metering unit. Alternatively, when higher image gloss is desired, such as from about 31 to about 60 gloss units as measured by the Gardner Gloss metering unit, higher gloss paper is utilized, such as from about 30 to about 60 gloss units, and which after image formation with small particle size toners of the present invention of preferably, for example, from about 3 to about 5 microns, (volume average diameter) and fixing thereafter results in a suitable high gloss toner image of from about 30 to about 60 gloss units as measured by the Gardner Gloss metering unit. The aforementioned toner to paper matching can be attained with, for example, small particle size toners, such as less than about 7 microns and preferably less than about 5 microns, such as from about 1 to about 4 microns, whereby the pile height of the toner layer or layers is considered low and acceptable.

Numerous processes are known for the preparation of toners, such as, for example, conventional polyester processes wherein a resin is melt kneaded or extruded with a pigment, micronized and pulverized to provide toner particles with a volume average particle diameter of from about 9 microns to about 20 microns and with broad geometric size distribution of from about 1.3 to about 1.5. In these processes, it is usually necessary to subject the aforementioned toners to a classification procedure such that a toner geometric size distribution of from about 1.3 to about 1.4 is attained. Also, in the aforementioned conventional process, low toner yields after classifications may be obtained. Generally, during the preparation of toners with average particle size diameters of from about 11 microns to about 15 microns, toner yields range from about 70 percent to about 85 percent after classification. Additionally, during the preparation of smaller sized toners with particle sizes of from about 7 microns to about 10 microns, lower toner yields may be obtained after classification, such as from about 50 percent to about 70 percent. With the processes of the present invention in embodiments, small average particle sizes of, for example, from about 3 microns to about 12 microns, and preferably from about 3 to about 5 microns are attained without resorting to classification processes, and wherein narrow geometric size distributions are attained, such as from about 1.16 to about 1.30, and preferably from about 1.16 to about 1.25. High toner yields also result, such as from about 90 percent to about 98 percent in embodiments of the present invention. In addition, by the toner particle preparation process of the present invention in embodiments, small particle size toners of from about 3 microns to about 7 microns can be economically prepared in high yields, such as from about 90 percent to about 98.9 percent by weight based on the weight of all the toner ingredients, such as toner resin and colorant.

PRIOR ART

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, there is disclosed a process for the preparation of toners by the polymerization of a polymerizable monomer dispersed by emulsification in the presence of a colorant and/or a magnetic powder to prepare a principal resin component, and then effecting coagulation of the resulting polymerization liquid in such a manner that the particles in the liquid after coagulation have diameters suitable for a toner. It is indicated in column 9 of this patent that coagulated particles of a size of 1 to 100, and particularly 3 to 70, are obtained; and in U.S. Pat. No. 4,558,108 there is disclosed a process for the preparation of a copolymer of styrene and butadiene by specific suspension polymerization.

The disadvantage, for example, of poor GSD requires classification resulting in low toner yields, reference for example U.S. Pat. No. 4,797,339, wherein there is disclosed a process for the preparation of toners by resin emulsion polymerization, wherein certain polar resins are selected;

Illustrated in U.S. Pat. No. 5,593,807, the disclosure of which is totally incorporated herein by reference in its entirety, is a process for the preparation of toner compositions comprising, for example, (i) preparing an emulsion latex comprised of sodio sulfonated polyester resin particles of from about 5 to about 500 nanometers in size diameter by heating said resin in water at a temperature of from about 65° C. to about 90° C.;

(ii) preparing a pigment dispersion in water by dispersing in water from about 10 to about 25 weight percent of sodio sulfonated polyester and from about 1 to about 5 weight percent of pigment;

(iii) adding the pigment dispersion to the latex mixture with shearing, followed by the addition of an alkali halide in water until aggregation results as indicated, for example, by an increase in the latex viscosity of from about 2 centipoise to about 100 centipoise;

(iv) heating the resulting mixture at a temperature of from about 45° C. to about 55° C. thereby causing further aggregation and enabling coalescence, resulting in toner particles of from about 4 to about 9 microns in volume average diameter and with a geometric distribution of less than about 1.3; and optionally (v) cooling the product mixture to about 25° C. and followed by washing and drying. The sulfonated polyesters of this patent may be selected for the processes of the present invention.

The process of the above patent may be disadvantageous in that, for example, the use of an alkali metal can result in a final toner resin which evidences some crosslinking or elastic reinforcement, primarily since the metal salt functions as a crosslinked site between the sulfonate groups contained on the polyester resin, causing an increase in viscosity and a decrease, or loss of high gloss characteristics for the polyester resin. These and other disadvantages and problems are minimized, or avoided with the processes of the present invention.

In U.S. Pat. No. 5,290,654, the disclosure of which is totally incorporated herein by reference, there is illustrated a process for the preparation of toners comprised of dispersing a polymer solution comprised of an organic solvent and a polyester, and homogenizing and heating the mixture to remove the solvent and thereby form toner composites. The appropriate polyesters of this patent may be selected for the processes of the present invention.

Emulsion/aggregation/coalescing processes for the preparation of toners are illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658;

5,585,215; 5,650,255; 5,650,256 and 5,501,935 (spherical toners). The appropriate components and processes of these Xerox Corporation patents may be selected for the invention of the present application in embodiments thereof.

SUMMARY OF THE INVENTION

It is a feature of the present invention to provide toner processes with many of the advantages illustrated herein.

In another feature of the present invention there are provided surfactant free, or substantially surfactant free processes for the preparation of black and colored toner compositions with, for example, excellent colorant dispersion and narrow GSD.

In another feature of the present invention there are provided simple and economical in situ processes wherein reduced amounts, or no surfactants are selected for black and colored toner compositions by an emulsion aggregation process, and wherein a sulfonated polyester is selected as the resin, reference for example copending patent application U.S. Ser. No. 221,595, pending the disclosure of which is totally incorporated herein by reference.

In a further feature of the present invention there is provided a process for the preparation of sulfonated polyesters containing toner compositions with a volume average diameter of from between about 1 to about 20 microns, and preferably from about 1 to about 7 microns in volume average diameter, and with a narrow GSD of, for example, from about 1.15 to about 1.35, and preferably from about 1.14 to about 1.22 as measured by a Coulter Counter.

In a further feature of the present invention there is provided a process for the preparation of toner compositions with certain effective particle sizes by controlling the temperature of the aggregation/coalescence, which process comprises stirring and heating at a suitable aggregation/coalescence temperature.

In a further feature of the present invention there is provided a process for the preparation of toners with particle size distribution which can be improved from about 1.4 to about 1.16 as measured by the Coulter Counter by increasing the temperature of aggregation/coalescence from about 25° C. to about 60° C., and preferably from about 45° C. to about 55° C.

In a further feature of the present invention there is provided a process that is rapid, for example the aggregation/coalescence time can be reduced to from about 1 to about 3 hours by increasing the temperature from room, about 25° C., (RT) to about 50° C. to about 60° C., and wherein the process consumes from about 1 to about 8 hours.

Moreover, in a further feature of the present invention there is * provided an economical process for the preparation of toner compositions, which after fixing to paper substrates results in images with a gloss of from about 20 GGU (Gardner Gloss Units) up to 70 GGU as measured by Gardner Gloss meter matching of toner and paper.

In another feature of the present invention there is provided a composite toner of polymeric resin with colorant, such as pigment or dye, and optional charge control agents in high yields of from about 90 percent to about 100 percent without resorting to classification, and wherein surfactants are avoided; processes for dissipating a polar charged sodium sulfonated polyester resin in water at about 10° C. to about 25° C. above the Tg of the polyester resin to form an emulsion latex, followed by mixing with colorant and polyelectrolyte, such as a water soluble polyelectrolyte, and thereafter heating the mixture to from about 30° C. to about 65° C. and preferably from about 45° C. to about 55° C. to effect aggregation/coalescence of the emulsion particles and colorant to form coalesced and fused toner particles of resin and colorant in the size range of, for example, from 1 to about 10 microns and preferably from about 3 to about 7 microns.

In yet another feature of the present invention there are provided toner compositions with low fusing temperatures of from about 110° C. to about 150° C. and with excellent blocking characteristics at from about 50° C. to about 60° C.

Yet another feature of the present invention resides in the preparation of reduced surfactant, or substantially free surfactant latexes, thereby reducing or eliminating extensive washings.

These and other features of the present invention are accomplished in embodiments by the provision of toners and processes thereof. In embodiments of the present invention, there are provided processes for the economical direct preparation of toner compositions by flocculation or heterocoagulation, and coalescence.

Aspects of the present invention include a surfactant free process for the preparation of toner comprising heating a mixture of a latex, a colorant, and a polyelectrolyte; a process wherein the polyelectrolyte and the heating enables aggregation and coalescence of the colorant and resin, or polymer contained in the latex, and thereafter optionally cooling and isolating the toner formed, and wherein the latex contains a polymer; a process for the preparation of toner compositions comprising (i) preparing an emulsion latex comprised of sulfonated polyester resin particles of from about 5 to about 300 nanometers in size diameter by heating the resin in water at a temperature of from about 60° C. to about 95° C.;

(ii) adding with shearing to the latex a colorant dispersion containing from about 20 to about 50 percent of colorant in water and with a mean colorant size range of from about 50 to about 150, or from about 75 to about 100 nanometers, followed by the addition of a polyelectrolyte;

(iii) heating the resulting mixture at a temperature of from about 45° C. to about 65° C. thereby causing aggregation and enabling coalescence, resulting in toner particles of from about 2 to about 20 microns in volume average diameter; and (iv) cooling the toner product mixture followed by isolation, and drying; a process wherein the polyelectrolyte is poly(dimethyldiallyl ammonium) chloride, poly(diethyidiallyl ammonium) bromide, poly (diallyldipropyl ammonium) bromide, poly (diallyldibutyl ammonium) bromide, copoly(diallyldiethyl ammonium) bromide-polyacrylic acid, or copoly(diallyldiethyl ammonium) bromide-poly (ethylene oxide); a process wherein the particle size distribution of the aggregated particles is about 1.40 decreasing to about 1.15, when the heating temperature is increased from room temperature, about 25° C. to about 55° C.; a process wherein the shearing is accomplished by homogenizing at from about 1,000 revolutions per minute to about 10,000 revolutions per minute, at a temperature of from about 25° C. to about 35° C., and for a duration of from about 1 minute to about 120 minutes; a process wherein there is selected as a polymer polyester is a polyester of poly(1,2-propylene-sodio 5-sulfoisophthalate), poly (neopentylene-sodio 5-sulfoisophthalate), poly (diethylene-sodio 5-sulfoisophthalate), copoly(1,2-propylene-sodio 5-sulfoisophthalate)-copoly-(1,2-propylene-terephthalate phthalate), copoly(1,2-propylene-diethylene sodio 5-sulfoisophthalate)-copoly-(1,2-propylene-diethylene-terephthalate phthalate), copoly(ethylene-neopentylene-sodio 5-sulfoisophthalate)-copoly-(ethylene-neopentylene-terephthalate-phthalate), or copoly(propoxylated bisphenol A)-copoly-(propoxylated bisphenol A-sodio 5-sulfoisophthalate); a process wherein the latex polyester is poly(1,2-propylene-sodio 5-sulfoisophthalate), poly(neopentylene-sodio 5-sulfoisophthalate), poly (diethylene-sodio 5-sulfoisophthalate), copoly(1,2-propylene-sodio 5-sulfoisophthalate)-copoly-(1,2-propylene-terephthalate phthalate), copoly(1,2-propylene-diethylene sodio 5-sulfoisophthalate)-copoly-(1,2-propylene-diethylene-terephthalate phthalate), copoly-(ethylene-neopentylene-sodio 5-sulfoisophthalate)-copoly-(ethylene-neopentylene-terephthalate-phthalate), or copoly(propoxylated bisphenol A)-copoly-(propoxylated bisphenol A-sodio 5-sulfoisophthalate); a process wherein the colorant is pigment or dye of carbon black, cyan, yellow, magenta, or mixtures thereof; a process wherein the toner isolated is from about 2 to about 15 microns in volume average diameter; a process wherein there is added to the surface of the formed toner metal salts, metal salts of fatty acids, silicas, metal oxides, or mixtures thereof, each in an amount of from about 0.1 to about 10 weight percent of the obtained toner; a substantially surfactant free process for the preparation of toner comprising admixing an emulsion latex comprised of sulfonated polyester resin particles with a colorant dispersion, and a polyelectrolyte, or polyelectrolytes and heating the resulting mixture; and optionally (v) cooling the mixture; a process wherein the emulsion latex comprised of sulfonated polyester resin particles is generated by heating the resin particles in water at a temperature of from about 15° C. to about 30° C. above the polyester resin glass transition temperature, wherein the colorant dispersion contains from about 20 to about 50 percent of predispersed colorant in water, followed by the addition of the polyelectrolyte; heating the resulting mixture at a temperature of from about 35° C. to about 65° C. thereby causing aggregation and coalescence of resin and colorant; and (vi) cooling the resulting mixture; a process wherein there is prepared an emulsion latex comprised of sodio sulfonated polyester resin particles by heating the resin in water, and subsequent to cooling the toner is isolated and then dried; a process wherein isolation is by filtration and cooling is to about 25° C. to about 30° C.; a process wherein the polyelectrolyte enables aggregation of resin, or polymer of the latex with colorant; a process wherein the polyelectrolyte is selected in an amount of from about 1 to about 7 weight percent; a process wherein the latex contains polyester resin, and wherein the polyester is a sodio sulfonated polyester resin of a size diameter of from about 10 to about 150 nanometers, and wherein the resulting toner is from about 3 to about 12 microns in volume average diameter; a process wherein the polyelectrolyte enables the aggregation and coalescence of the latex and colorant, and wherein the latex contains resin particles; a process wherein the polyelectrolyte is poly(diallyidimethyl ammonium) chloride or poly(diallyldiethyl ammonium) bromide; a process wherein the polyester resin is copoly(neopentylene-diethylene)terephthalate-copoly(sodium sulfoisophthalate dicarboxylate), or copoly(1,2-propylene-diethylene)terephthalate-copoly (sodium sulfoisophthalate dicarboxylate); a process wherein the latex contains a polyester resin of the formula

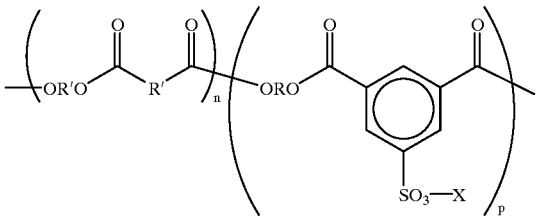

wherein R is an alkylene; R' X is an alkaline ion, an alkaline earth metal, a metal, or an ammonium cation; is an arylene; and p and n represent the number, such as from 1 to about 1,000 for example, of randomly repeating segments; a process wherein the polyester resin is a random copolymer, and wherein the n and p segments are separated; a toner obtained by the process; a developer comprised of the toner and carrier; a process wherein the polyelectrolyte is poly (diallyldimethyl ammonium) chloride or poly(diallyidiethyl ammonium) bromide; a process wherein the polyelectrolyte is poly(diallyldimethyl ammonium) chloride or poly (diallyldiethyl ammonium) bromide; a process for the preparation of toner comprised of mixing a latex with a colorant, and a polyelectrolyte; a process wherein the mixture is heated; followed by cooling and isolating the toner; a process wherein the polyelectrolyte is of the formula

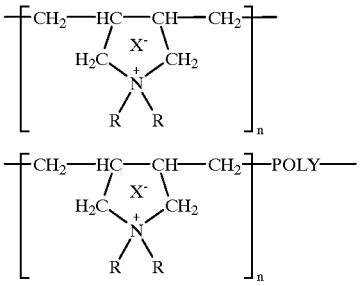

wherein R is alkyl and n represents the number of segments; surfactant free processes for the preparation of toner compositions, which comprises initially attaining or generating a colorant, such as a pigment dispersion, for example, by dispersing an aqueous mixture of a colorant, especially pigment or pigments, such as carbon black like REGAL 330® obtained from Cabot Corporation, red, green, blue, orange, phthalocyanine, quinacridone or RHODAMINE B™, and generally pigments or dyes of cyan, magenta, yellow, or mixtures thereof, by utilizing a high shearing device, such as a Brinkmann Polytron, thereafter shearing this mixture by utilizing a high shearing device, such as a Brinkmann Polytron, a sonicator or microfluidizer with a suspended resin mixture comprised of a resin, preferably a polyester polymer component, adding an a polyelectrolyte, and subsequently heating to enable aggregation/coalescence; and a substantially free toner surfactant process by forming a latex of a polyester, such as a sodium sulfonated polyester resin in water, mixing the latex with a colorant, especially pigment dispersion containing a coagulating polyelectrolyte, and thereafter, heating the resulting mixture to primarily enable the generation of toner aggregates and coalesced toner particles. The polyester resin selected preferably contains sulfonated groups thereby rendering them dissipatable, that is, they form spontaneous emulsions in water without the use of organic solvents, especially above the glass transition temperature, Tg, of the polyester resin. The process of the present invention can be considered a substantially surfactant free chemical method wherein sulfopolyester particles are aggregated and coalesced in the presence of a polyelectrolyte by mixing and optionally by heating wherein during mixing and, for example, from about 45° C. to about 55° C., or other suitable temperature, generates toner size particles with, for example, an average particle volume diameter of from about 1 to about 25 and preferably about 2 to about 10 microns. It is believed that during the heating the components of the sulfonated polyester latex and the colorant dispersion aggregate and fuse together to form composite toner particles. Additionally, it is believed the polyelectrolytes can function as ionic macromolecular crosslinking agents. More specifically, it is believed that the electrolyte can be ionically linked through multiple sulfonate sites or other suitable sites along the backbone of the polyester resin latex, or other suitable resin latex resulting in sufficient ionic crosslinks and aggregate growth and forming colorant, such as pigmented polyester resin toner particles. In another embodiment thereof, the present invention is directed to an in situ process comprised of first, HELIOGEN BLUE™ or HOSTAPERM PINK™, dyes and the like, reference the Color Index, in an aqueous mixture utilizing a high shearing device, such as a Brinkmann Polytron, microfluidizer or sonicator, thereafter shearing this mixture with a latex of suspended polyester resin particles, and which particles are preferably, for example, of a size ranging from about 5 to about 500, and more preferably about 10 to about 250 nanometers in volume average diameter, as measured by the Brookhaven nanosizer. Thereafter, the aforethe mixture is contacted with a polyelectrolyte, and heated with stirring for a suitable time period of, for example, from about 1 to about 8 hours, and which heating is, for example, from about 40° C. to about 60° C., and preferably from about 45° C. to about 55° C., thereby resulting in the aggregation and simultaneous coalescence of the resin particles with the colorant, and permitting the formation of particles ranging in size of from about 0.5 micron to about 20 microns and preferably from about 2 to about 10 microns in volume average diameter size as measured by the Coulter Counter (Microsizer II). The size of the coalesced particles and their distribution can be controlled by, for example, the amount of components, such as polyelectrolyte, and by the temperature of heating, and wherein the speed at which toner size particles are formed can also be controlled by the temperature. The particles obtained after heating can be subjected to cooling, washing with, for example, water to remove residual polyelectrolyte, and drying whereby there are obtained toner particles comprised of resin and colorant, and which toner can be of various particle size diameters, such as from 1 to about 20, and preferably about 12 microns in volume average particle diameter.

With the processes of the present invention, there can be prepared a toner by (i) preparing an emulsion latex comprised of sodio sulfonated polyester resin particles of a size of from about 5 to about 300 nanometers, and preferably about 10 to about 250 nanometers, and in an amount of from about 5 to about 40 weight percent by heating the resin in water at a temperature of from about 45° C. to about 80° C.;

(ii) adding, with shearing, or extensive high speed mixing, a colorant dispersion containing, for example, about 20 to about 50 percent of predispersed colorant in water, with a mean colorant size ranging from about 50 to about 150 nanometers, to the latex mixture comprised of sulfonated polyester resin particles in water, followed by the controlled, slow addition of a polyelectrolyte in an amount, for example, of from about 0.5 to about 25 weight percent in water, and preferably 1 to 7 weight percent in water;

(iii) heating the above resulting mixture at a temperature of, for example, from about 35° C. to about 60° C. and preferably from about 45° C. to about 55° C. thereby causing aggregation and coalescence resulting in toner particles of, for example, from about 4 to about 10 microns in size with a geometric distribution of less than about 1.3; and optionally (iv) cooling the product mixture to about 25° C., followed by isolating, filtering and drying;

(i) preparing, or providing an emulsion latex of sodio sulfonated polyester resin particles of a size of from about 5 to about 500 nanometers and preferably from about 10 to about 250 nanometers in size diameter by heating the resin in water at a temperature of from about 65° C. to about 90° C.;

(ii) adding a colorant, preferably in the form of a dispersion to the above latex mixture and to a polyelectrolyte in water;

(iii) heating the resulting mixture at a temperature of from about 35° C. to about 60° C. and preferably from about 45° C. to about 55° C. thereby causing aggregation and enabling coalescence resulting in toner particles of, for example, from about 4 to about 12 microns in volume average diameter and with a geometric distribution of less than about 1.3; and (iv) cooling the product mixture to about 25° C., followed by filtering and drying; a surfactant free process comprising (i) preparing an emulsion latex comprised of sodio sulfonated polyester resin particles of less than about 0.1 micron in size by heating the resin in water at a temperature of, for example, from about 5° C. to about 30° C. and preferably from about 10° C. to about 20° C. above the resin glass transition temperature;

(ii) adding a colorant dispersion to the latex mixture, followed by the addition of a polyelectrolyte component of from about 1 to about 5 weight percent in water;

(iii) heating the resulting mixture at a temperature of from about 35° C to about 60° C. and preferably from about 45° C. to about 55° C. causing aggregation and coalescence thereby resulting in toner particles;

(iv) cooling the product mixture, followed by filtering and drying; a process for the preparation of toner compositions comprising (i) preparing an emulsion latex comprised of sodio sulfonated polyester resin particles and water by heating;

(ii) adding the pigment dispersion to the above latex mixture comprised of sulfonated polyester resin particles in water with shearing, followed by the addition of a polyelectrolyte; and (iii) heating the resulting mixture thereby causing aggregation and enabling coalescence;

a surfactant free process for the preparation of toner comprising heating a mixture of an emulsion latex, a colorant, and a polyelectrolyte; a process for the preparation of toner compositions comprising (i) preparing an emulsion latex comprised of polymers, such as sodio sulfonated polyester resin particles of from about 5 to about 400 nanometers in size diameter by heating the polymer, or the resin in water at a temperature of from about 65° C. to about 90° C.;

(ii) adding with shearing to the latex a colorant dispersion containing from about 20 to about 50 percent of pre-dispersed colorant in water and with a mean colorant size range of from about 50 to about 150 nanometers, followed by the addition of a polyelectrolyte;

(iii) heating the resulting mixture at a temperature of from about 45° C. to about 65° C. thereby causing aggregation and enabling coalescence, resulting in toner particles of from about 2 to about 20 microns in volume average diameter; and (iv) cooling the toner product mixture followed by isolation, and drying; a toner process wherein the polyelectrolyte is, for example, poly(diallyidimethyl ammonium)chloride, poly(diallyldimethyl ammonium) bromide, poly(diallyldiethyl ammonium)bromide, poly (diallyldipropyl ammonium)bromide, poly (diallyldibutyl ammonium)bromide, copoly (diallyidiethyl ammonium)bromide-polyacrylic acid, copoly(diallyldiethyl ammonium)bromide-poly (ethylene oxide), and the like; a toner process wherein the shearing is accomplished by homogenizing at from about 1,000 revolutions per minute to about 10,000 revolutions per minute at a temperature of from about 25° C. to about 35° C., and for a duration of from about 1 minute to about 120 minutes; a process wherein the polyelectrolyte is of the formula

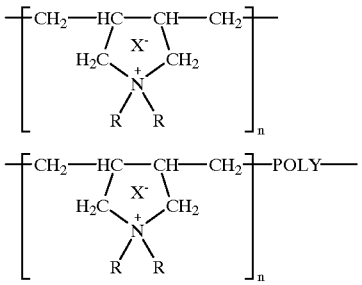

wherein R is a suitable substituent such as, for example, alkyl, and more specifically, the alkyl group $(CH_2)_nCH_3$ wherein n is a number of from about 0 to about 8, examples of alkyl being methyl, ethyl, butyl, X is a halide or other anionic counterions, such as chlorine, bromine, acetate and the like, and each n represents the number of repeating segments, and more specifically, n is a number of from about 10 to about 200, and poly refers to more than one and the like; a toner process wherein the polyester is a polyester of poly(1,2-propylene-sodio 5-sulfoisophthalate), poly (neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalate phthalate), copoly(1,2-propylene-diethylene sodio 5-sulfoisophthalate)-copoly-(1,2-propylene-diethylene-terephthalate phthalate), copoly(ethylene-neopentylene-sodio 5-sulfoisophthalate)-copoly-(ethylene-neopentylene-terephthalate-phthalate), or copoly(propoxylated bisphenol A)-copoly-(propoxylated bisphenol A-sodio 5-sulfoisophthalate); a toner process wherein there is selected a polyelectrolyte, and wherein the polyester of (i) is a polyester of poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalate phthalate), copoly(1,2-propylene-diethylene sodio 5-sulfoisophthalate)-copoly-(1,2-propylene-diethylene-terephthalate phthalate), copoly(ethylene-neopentylene-sodio 5-sulfoisophthalate)-copoly-(ethylene-neopentylene-terephthalate-phthalate), or copoly(propoxylated bisphenol A)-copoly-(propoxylated bisphenol A-sodio 5-sulfoisophthalate); a process wherein the colorant is carbon black, cyan, yellow, magenta, or mixtures thereof; a process wherein the toner particles isolated are from about 2 to about 15 microns in volume average diameter, and the geometric size distribution thereof is from about 1.15 to about 1.35; a process wherein there is added to the surface of the formed toner metal salts, metal salts of fatty acids, silicas, metal oxides, or mixtures thereof, each in an amount of from about 0.1 to about 10 weight percent of the obtained toner; a process wherein the polyelectrolyte is selected in an amount of from about 1 to about 5 weight percent; a process wherein the polyester is a sodio sulfonated polyester resin of a size diameter of from about 10 to about 150 nanometers, and wherein the toner is from about 3 to about 12 microns in volume average diameter; a process wherein the polyelectrolyte, which can also function as a coagulant, provides for the aggregation and coalescence of the resin, or polymer of the latex, which can contain water, and colorant; a process wherein the polyester resin is of the formula

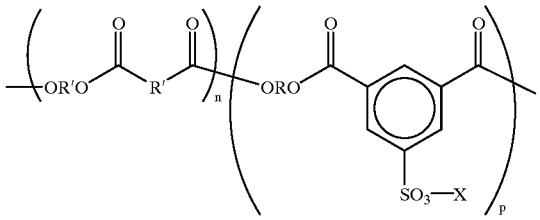

wherein R is, for example, an alkylene, and more specifically, wherein R is an alkylene segment of, for example, $(CH_2)$, wherein n represents the number of segments, and is, for example, from about 1 to about 10, such as methylene, ethylene, butylene and the like, R' is an arylene with, for example, from about 6 to about 30 carbon atoms, such as phenyl, diphenyl, and the like; p and n represent the number of randomly repeating segments where the number of p repeat segments are between about 20 to about 200, the n segments are between about 10 to about 50; and a process wherein the polyester resin is a random copolymer, and wherein the n and p segments of the sulfonated portion are separated and range for p to from about 20 to about 200 units, and for n segments from about 10 to about 50 units.

In some instances, colorants, such as pigments available in the wet cake form or concentrated form containing water, can be easily dispersed utilizing a homogenizer or stirring. In other embodiments, pigments are available in a dry form, whereby a dispersion in water is preferably effected by microfluidizing using, for example, an M-110 microfluidizer and passing the pigment dispersion from about 1 to about 10 times through the chamber of the microfluidizer, or by sonication, such as using a Branson 700 sonicator.

The preferred resin selected for the processes of the present invention is a sulfonated polyester, examples of which include those as illustrated in copending application U.S. Ser. No. 221,595, the disclosure of which is totally incorporated herein by reference, and the appropriate patents recited herein, such as a sodio sulfonated polyester, and more specifically, a polyester, such as poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalate phthalate), copoly(1,2-propylene-diethylene-sodio 5-sulfoisophthalate)-copoly-(1,2-propylene-diethylene-terephthalate-phthalate), copoly(ethylene-neopentylene-sodio 5-sulfoisophthalate)-copoly-(ethylene-neopentylene-terephthalate-phthalate), and copoly(propoxylated bisphenol A)-copoly-(propoxylated bisphenol A)-sodio 5-sulfoisophthalate. The sulfonated polyesters may in embodiments be represented by the following formula, or random copolymers thereof wherein the n and p segments are separated

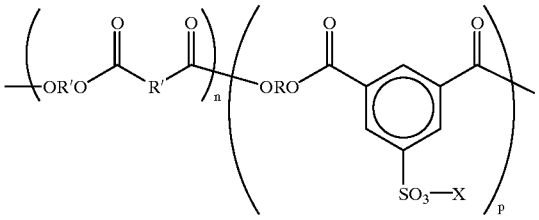

wherein R is an alkylene of, for example, from about 2 to about 25 carbon atoms, such as ethylene, propylene, butylene, oxyalkylene diethyleneoxide, and the like; R' is an arylene of, for example, from about 6 to about 36 carbon atoms, such as a benzylene, bisphenylene, bis(alkyloxy) bisphenolene, and the like; and p and n represent the number of randomly repeating segments, such as for example from about 10 to about 10,000. The alkali sulfopolyester possesses, for example, a number average molecular weight ($M_n$) of from about 1,500 to about 50,000 grams per mole, a weight average molecular weight ($M_w$) of from about 6,000 grams per mole to about 150,000 grams per mole as measured by gel permeation chromatography and using polystyrene as standards. Other resin examples can include anionic type polymers, a poly(styrene sodium sulfonate), poly(styrene sodium sulfonate, poly(methylstyrenesodium acrylate), water soluble anionic resins, and the like.

Various known colorants, inclusive of dyes, pigments, and mixtures thereof, present in the toner in an effective amount of, for example, from about 1 to about 25 percent by weight of the toner, and preferably in an amount of from about 2 to about 12 weight percent, that can be selected include carbon black like REGAL 330®; magnetites, such as Mobay magnetites M08029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colorants, there can be selected cyan, magenta, yellow, red, green, brown, blue or mixtures thereof. Specific examples of colorants include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, suitable food dyes, dyes available form Sun Chemicals, such as red 81:3, and the like. Generally, colorants that can be selected are cyan, magenta, or yellows, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. The colorants selected are present in various effective amounts as indicated herein, and generally from about 1 weight percent to about 65 weight and preferably from about 2 to about 12 percent, of the toner.

Colorants include dyes, pigments, mixtures thereof, mixtures of pigments, mixtures of dyes, and the like.

Examples of polyelectrolytes, especially cationic polyelectrolytes are poly(diallyldimethyl ammonium) chloride, poly(diallyldimethyl ammonium) bromide, poly (diallyldiethyl ammonium) bromide, poly(diallyidipropyl ammonium) bromide, poly(diallyldibutyl ammonium) bromide, copoly(diallyldiethyl ammonium) bromide-polyacrylic acid, copoly(diallyldiethyl ammonium) bromide-poly(ethylene oxide), poly(methylstyrene-triethyl ammonium) chloride, poly(vinylmethylpyridinium) bromide, poly(vinylmethylpyridinium) chloride, poly (vinylmethylpyridinium) iodide, poly (vinylmethylpyrazinium) bromide, poly (vinylmethylpyrazinium) chloride, and poly (vinylmethylpyrazinium) iodide. The concentration, or amount of the polyelectrolyte selected is in embodiments, for example from about 0.5 to about 25 percent by weight, and preferably from about 1 to about 7 percent by weight of the amount of the resin, or based on the total amount of all components in embodiments.

Surface additives that can be added to the toner compositions after isolation by, for example, filtration, and then optionally followed by washing and drying include, for example, metal salts, metal salts of fatty acids, colloidal silicas, titanium oxides, mixtures thereof, and the like, which additives are each usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate, silicas, such as AEROSIL R972®, and other silicas available from Cabot Corporation Degussa Company, and the coated silicas of copending applications U.S. Ser. No. 09/131,188 now U.S. Pat. No. 6,015,601, U.S. Ser. No. 09/132,623 pending, and U.S. Ser. No. 09/132,185 pending, the disclosures of each application being totally incorporated herein by reference. These additives can be selected in amounts of, for example, from about 0.1 to about 2 percent, and which additives can be incorporated during the aggregation, or blended into the formed toner product. The toner may also include known charge additives in effective amounts of, for example, from about 0.1 to about 5 weight percent, such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of each of these patents being totally incorporated herein by reference, negative charge enhancing additives like aluminum complexes, and the like. Other known positive and negative enhancing charge additives may also be selected.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration. The carrier particles may also be comprised of a carrier core with a polymer coating, or coatings thereover, and dispersed therein a conductive component like a conductive carbon black in an amount, for example, of from about 5 to about 60 weight percent.

Imaging methods are also envisioned with the toners of the present invention, reference for example a number of the patents mentioned herein, and U.S. Pat. Nos. 4,265,990; 4,585,884; 4,563,408 and 4,584,253, the disclosures of which are totally incorporated herein by reference.

The following Examples are provided. These Examples are intended to be illustrative only and are not intended to limit the scope of the present invention. Also, parts and percentages are by weight unless otherwise indicated.

EXAMPLES

Preparation Of Sulfonated Polyesters:

Moderately sulfonated polyesters prepared by polycondensation reactions were selected with a sufficient loading of sulfonate groups (between about 2.5 to about 20 mol percent sulfonate groups of the polymer repeat unit) to permit the dissipation in water of the polymer to a submicron sized emulsion (5 to 200 nanometers particle size).

Preparation of Linear Moderately Sulfonated Polyester:

A linear sulfonated random copolyester resin comprised of, on a mol percent, approximately 0.465 of terephthalate, 0.035 of sodium sulfoisophthalate, 0.475 of 1,2-propanediol, and 0.025 of diethylene glycol was prepared as follows. In a one liter Parr reactor equipped with a bottom drain valve, double turbine agitator, and distillation receiver with a cold water condenser were charged 388 grams of dimethylterephthalate, 44.55 grams of sodium dimethylsulfoisophthalate, 310.94 grams of 1,2-propanediol (1 mole excess of glycol), 22.36 grams of diethylene glycol (1 mole excess of glycol), and 0.8 gram of butyltin hydroxide oxide as the catalyst. The reactor was then heated to 165° C. with stirring for 3 hours whereby 115 grams of distillate were collected in the distillation receiver, and which distillate was comprised of about 98 percent by volume of methanol and 2 percent by volume of 1,2-propanediol as measured by the ABBE refractometer available from American Optical Corporation. The mixture was then heated to 190° C. over a one hour period, after which the pressure was slowly reduced from atmospheric pressure to about 260 Torr over a one hour period, and then reduced to 5 Torr over a two hour period with the collection of approximately 122 grams of distillate in the distillation receiver, and which distillate was comprised of approximately 97 percent by volume of 1,2-propanediol and 3 percent by volume of methanol as measured by the ABBE refractometer. The pressure was then further reduced to about 1 Torr over a 30 minute period whereby an additional 16 grams of 1,2-propanediol were collected. The reactor was then purged with nitrogen to atmospheric pressure, and the polymer discharged through the bottom drain onto a container cooled with dry ice to yield 460 grams of the 3.5 mol percent sulfonated polyester resin, copoly(1,2-propylene-diethylene)terephthalate-copoly (sodium sulfoisophthalate dicarboxylate). The sulfonated polyester resin glass transition temperature was measured to be 59.5° C. (onset) utilizing the 910 Differential Scanning Calorimeter, available from E.I. DuPont, operating at a heating rate of 10° C. per minute. The number average molecular weight was measured to be 3,250 grams per mole, and the weight average molecular weight was measured to be 5,290 grams per mole using tetrahydrofuran as the solvent. A particle size of 57 nanometers (volume weighted) was measured using a Nicomp particle sizer.

Preparation of Latex Stock Solutions:

Submicron dispersions of the above sulfonated polyester resin, were prepared in distilled deionized water by first heating the water to about 10° C. to about 15° C. above the glass transition of the sulfonated polyester polymer and then slowly adding the polymer with stirring until it has fully dispersed. The resulting latexes had a characteristic blue tinge and a resin particle size in the range of from about 5 to about 100 nanometers. In general, 50 grams of the sulfonated polyester were dissipated in 200 grams of water.

Flushed Pigmented Polyester Dispersions:

There was mixed with the highly sulfonated polyester, copoly(1,2-propylene-diethylene)terephthalate-copoly (sodium sulfoisophthalate dicarboxylate) containing 10 mol percent sulfonate groups in the repeat unit polymer backbone and, respectively, flushed REGAL 330® carbon black pigment dispersion (Sun Chemical, 40 percent by weight pigment in water), Cyan Pigment 15:3 dispersion (Sun Chemical, 54 percent by weight pigment in water), Magenta Red 81:3 pigment dispersion (Sun Chemical, 21 percent by weight pigment in water), and Yellow 180 pigment dispersion (Sun Chemical, 25 percent by weight pigment in water). The mixtures of polyester and colorant can also be obtained form Sun Chemicals.

Preparation of Polyelectrolytes:

Synthesis of Diallydiethylammonium Bromide Monomer:

The diethyidiallylammonium bromide monomer was prepared in two steps. 60.5 Grams (0.5 mol) of allyl bromide were slowly added to 160 grams (2.20 mol) of diethylamine in 100 milliliters of acetone. After about 15 minutes, the solution became cloudy and white crystals of the byproduct, allyl ammonium hydrogen bromide, were formed. The solution containing allyldiethyl amine was filtered, and distilled at 112° C. under nitrogen to purify the material. The allyldiethyl amine was redissolved in 200 milliliters of acetone, and more allyl bromide added slowly. Crystals of the product, diallydiethylammonium bromide, precipitated out immediately. The product was recovered by filtration and washed with several quantities of acetone, and dried under vacuum.

Cyclopolymerization of Poly(diallyl diethyl ammonium) bromide:

In a 100 milliliter round bottom flask equipped with a reflux condenser were added 23.7 grams (0.1 mols) of diallydiethylammonium bromide monomer, or diallydiethylammonium chloride to generate poly(diallyldiethyl ammonium) chloride dissolved in 12 milliliters of water, and 4.27 grams (0.033 mols) of the initiator t-butylhydroperoxide (70 percent). The reaction was heated in air at 60° C. for 48 hours. The viscous solution was diluted with more water and precipitated in a methanol/ether mix. The polymer, poly(diallyl diethyl ammonium) bromide, was found by Gel permeation chromatography to have an absolute molecular weight of ($M_w$)=3,900, and number average molecular weight ($M_n$) of 1,390. The polymer was recovered as white powder after vacuum drying. Yield was 85 percent (20.1 grams).

Stock Solutions of Polyelectrolytes:

Poly(diallyldimethyl ammonium) chloride ($M_w$≈18,000 daltons) was obtained from the Calgon Corporation as a 38 percent weight percent polymer in water. 5 Weight percent stock solutions of this polyelectrolyte were prepared by diluting 7.6 grams of the stock solution with 100 milliliters of distilled deionized water. Poly(diallyldiethylammonium) bromide ($M_w$≈10,000 daltons) was prepared as described above. 5 Weight percent stock solutions of this polyelectrolyte were prepared by dissolving 5 grams of polymer with 100 grams of distilled deionized water.

Aggregation with Poly(diallyldimethylammonium) chloride Poly(electrolyte):

Example I

Cyan Toner Preparation:

50 Grams of the 3.5 mol percent sulfonated polyester resin emulsion, or latex as prepared above were mixed with 5.4 grams of a Cyan Pigment 15:3 dispersion (Sun Chemical, 54 percent by weight pigment in water) followed by shearing at 3,000 revolutions per minute using a Brinkmann polytron for a duration of about 2 minutes. To this was added with stirring 1.0 gram of the 5 weight percent stock solution containing the poly(diallyldimethylammonium) chloride polyelectrolyte. The resulting mixture was then heated to about 52° C. with stirring. After 8 hours, the particle size of the cyan toner was 850 nanometers. 25 More milliliters of the 5 weight percent stock solution (0.5 gram of the poly(diallyidimethylammonium) chloride were added. After 5 more hours, the particle size was 3.5 microns as measured by the Coulter Counter. An additional 2 hours of heating at 52° C. resulted in cyan toner particles with an average particle size of about 7.2 microns and GSD of 1.25 as measured by the Coulter Counter. The cyan toner was comprised of about 96.5 weight percent of the 3.5 mol percent of the sulfonated polyester resin and 3.5 weight percent of Cyan Pigment 15:3.

Collection of Product:

The above mixture was diluted with 150 milliliters of cold water cooled to room temperature, about 25° C., filtered, washed with about 200 grams of water and dried using a freeze dryer. There were achieved 50 gloss units measured using a gloss meter at a low fusing temperature of about 170° C. when the toner obtained was fused on a Xerox Corporation laboratory fuser similar to the Xerox Corporation 5090 fuser. Thus, this toner is considered a glossy toner.

Example II

Magenta Toner Preparation:

50 Grams of the 3.5 mol percent sulfonated polyester resin emulsion, or latex as prepared above were mixed with 2.4 grams of a magenta Red 81:3 pigment dispersion (Sun Chemical, 21 percent by weight pigment in water) followed by shearing at 3,000 revolutions per minute using a Brinkmann polytron for a duration of about 2 minutes. To this was added with stirring 1.0 gram of the 5 weight percent stock solution containing the poly(dimethyldiallylammonium) chloride polyelectrolyte. The resulting mixture was then heated to about 52° C., and stirring was then continued for 6 hours. 25 More milliliters of the 5 weight percent stock solution (0.5 gram of the poly(diallyldimethylammonium) chloride were added and heating continued for an additional 2 hours at 52° C. resulting in magenta toner particles with an average particle size of about 5.8 microns and GSD of 1.20 as measured by the Coulter Counter. The magenta toner was comprised of about 95 weight percent of the 3.5 mol percent sulfonated polyester resin and 5 weight percent of the red Pigment 81:3.

Collection of Product:

The above mixture was diluted with 100 milliliters of cold water cooled to room temperature, about 25° C., filtered, washed with about 100 grams of water and dried using a freeze dryer. There were achieved 50 gloss units measured using a gloss meter at a low fusing temperature of about 175° C. when the toner obtained was fused on a Xerox Corporation laboratory fuser similar to the Xerox Corporation 5090 fuser. Thus, this toner is considered a glossy toner.

Example III

Yellow Toner Preparation:

50 Grams of the 3.5 mol percent sulfonated polyester resin emulsion, or latex as prepared above were mixed with 2 grams of a Yellow 180 pigment dispersion (Sun Chemical, 25 percent by weight pigment in water) followed by shearing at 3,000 revolutions per minute using a Brinkmann polytron for a duration of about 2 minutes. To this was added with stirring 1.0 gram of the 5 weight percent stock solution containing the poly(dimethyldiallylammonium) chloride polyelectrolyte. The resulting mixture was then heated to about 52° C. and stirring was continued for 6.5 hours. 25 More milliliters of the 5 weight percent stock solution (0.5 gram of the poly(diallyldimethylammonium) chloride were added and heating continued for an additional 2.5 hours at 52° C. resulting in yellow toner particles with an average particle size of about 6.1 microns and GSD of 1.19 as measured by the Coulter Counter. The resulting yellow toner was comprised of about 92.8 weight percent of the 3.5 mol percent sulfonated polyester resin and 7.2 weight percent of the Yellow 180 pigment.

Collection of Product:

The above mixture was diluted with 150 milliliters of cold water cooled to room temperature, about 25° C., filtered, washed with about 100 grams of water and dried using a freeze dryer. There were achieved 50 gloss units as measured using a gloss meter at a low fusing temperature of about 177° C. when the toner obtained was fused on a Xerox Corporation laboratory fuser similar to the Xerox Corporation 5090 fuser. Thus, this toner is considered a glossy toner.

Example IV

Black Toner Preparation:

50 Grams of the 3.5 mol percent sulfonated polyester resin emulsion, or latex as prepared above were mixed with 5 grams of a REGAL 330® carbon black pigment dispersion (Sun Chemical, 40 percent by weight pigment in water) followed by shearing at 3,000 revolutions per minute using a Brinkmann polytron for a duration of about 2 minutes. To this was added with stirring 1.0 gram of the 5 weight percent stock solution containing the poly (dimethyldiallylammonium) chloride polyelectrolyte. The resulting mixture was then heated to about 52° C., and stirring was continued for 7.0 hours. 25 More milliliters of the 5 weight percent stock solution (0.5 gram of is the poly(diallyldimethylammonium) chloride were added and heating continued for an additional 3 hours at 52° C. resulting in black toner particles with an average particle size of about 6.4 microns and GSD of 1.24 as measured by the Coulter Counter. The resulting black toner was comprised of about 95 weight percent of the 3.5 mol percent sulfonated polyester resin and 5 weight percent of the REGAL 330® carbon black.

Collection of Product:

The above mixture was diluted with 500 milliliters of cold water cooled to room temperature, about 25° C., filtered, washed with about 500 grams of water and dried using a freeze dryer. There were achieved 50 gloss units measured using a gloss meter at a low fusing temperature of about 180° C. when the above prepared black toner obtained was fused on a Xerox Corporation laboratory fuser similar to the Xerox Corporation 5090 fuser. Thus, this toner is considered a glossy toner.

Aggregation with Poly(dialiyidiethylammonium) bromide Poly(electrolyte):

Example V

Cyan Toner Preparation:

50 Grams of the 3.5 mol percent sulfonated polyester resin emulsion, or latex as prepared above were mixed with 5.4 grams of a Cyan Pigment 15:3 dispersion (Sun Chemical, 54 percent by weight pigment in water) followed by shearing at 3,000 revolutions per minute using a Brinkmann polytron for a duration of about 2 minutes. To this was added with stirring 1.0 gram of the 5 weight percent stock solution containing a poly(diethyldiallylammonium) bromide polyelectrolyte. The resulting mixture was then heated to about 52° C. with stirring. After 6 hours, the particle size was 1.1 microns as measured using a Coulter Counter. 25 More milliliters of the 5 weight percent stock solution (0.5 gram of the poly(diallyldiethylammonium) bromide were added. After 3 more hours of heating at 52° C., the particle size was 4.0 microns as measured by the Coulter Counter. An additional 1 hour of heating at 52° C. resulted in cyan toner particles with an average particle size of about 6.8 microns and GSD of 1.23 as measured by the Coulter Counter. The cyan toner was comprised of about 96.5 weight percent of 3.5 mol percent sulfonated polyester resin and 3.5 weight percent of Cyan Pigment 15:3.

Collection of Product:

The above mixture was diluted with 150 milliliters of cold water cooled to room temperature, about 25° C., filtered, washed with about 200 grams of water and dried using a freeze dryer. There were achieved 50 gloss units measured using a gloss meter at a low fusing temperature of about 170° C. when the toner obtained was fused on a Xerox Corporation laboratory fuser similar to the Xerox Corporation 5090 fuser. Thus, this toner is considered a glossy toner.

Other embodiments and modifications of the present invention may occur to those of ordinary skill in the art subsequent to a review of the present application and the information presented herein; these embodiments modifications, and equivalents, or substantial equivalents thereof, are also included within the scope of this invention.

What is claimed is:

1. A surfactant free process for the preparation of toner comprising heating a mixture of a latex, a colorant, and a polyelectrolyte, wherein said polyelectrolyte and said heating enables aggregation and coalescence of said colorant and resin or polymer contained in said latex, and thereafter optionally cooling and isolating the toner formed, and wherein the resin or polymer is a sulfonated polyester.

2. A process in accordance with claim 1 wherein the polyelectrolyte is poly(dimethyldiallyl ammonium) chloride, poly(diethyidiallyl, ammonium) bromide, poly (diallyldipropyl ammonium) bromide, poly(diallyidibutyl ammonium) bromide, copoly(diallyl-diethyl ammonium) bromide-polyacrylic acid, or copoly(diallyldiethyl ammonium) bromide-poly(ethylene oxide).

3. A process in accordance with claim 1 wherein the GSD of the aggregated particles is about 1.40 and decreases to about 1.15, when the heating temperature is increased from room temperature, about 25° C. to about 55° C.

4. A process in accordance with claim 1 wherein the polymer of the latex is a polyester of poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalate phthalate), copoly(1,2-propylene-diethylene sodio 5-sulfoisophthalate)-copoly-(1,2-propylene-diethylene-terephthalate phthalate), copoly(ethylene-neopentylene-sodio 5-sulfoisophthalate)-copoly-(ethylene-neopentylene-terephthalate-phthalate), or copoly(propoxylated bisphenol A)-copoly-(propoxylated bisphenol A-sodio 5-sulfoisophthalate).

5. A process in accordance with claim 1 wherein the colorant is carbon black, cyan, yellow, magenta, or mixtures thereof.

6. A process in accordance with claim 1 wherein the toner formed is isolated and which formed toner is from about 2 to about 15 microns in volume average diameter.

7. A process in accordance with claim 1 wherein there is added to the surface of the formed toner metal salts, metal salts of fatty acids, silicas, metal oxides, or mixtures thereof, each in an amount of from about 0.1 to about 10 weight percent of the obtained toner.

8. A process in accordance with claim 1 wherein the polyelectrolyte is selected in an amount of from about 1 to about 7 weight percent.

9. A process in accordance with claim 1 wherein the latex contains polyester resin, and wherein said polyester is a sodio sulfonated polyester resin of a size diameter of from about 10 to about 150 nanometers, and wherein said resulting toner is from about 3 to about 12 microns in volume average diameter.

10. A process in accordance with claim 1 wherein the polyelectrolyte is poly(diallyldimethyl ammonium) chloride or poly(diallyldiethyl ammonium) bromide.

11. A process in accordance with claim 10 wherein the polyester resin is copoly(neopentylene-diethylene) terephthalate-copoly(sodium sulfoisophthalate dicarboxylate), or copoly(1,2-propylene-diethylene) terephthalate-copoly(sodium sulfoisophthalate dicarboxylate).

12. A process in accordance with claim 1 wherein the latex contains a polyester resin of the formula

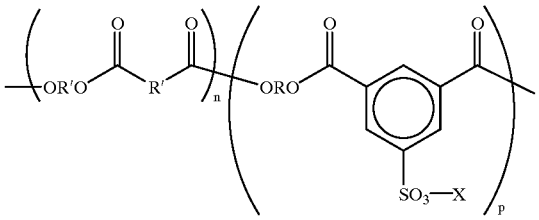

wherein R is an alkylene; R' is an arylene; and p and n represent the number of randomly repeating segments, and wherein X is an alkaline ion, an alkaline earth metal, a metal, or an ammonium cation.

13. A process in accordance with claim 12 wherein said polyester resin is a random copolymer, and wherein the n and p segments are separated.

14. A process in accordance with claim 1 wherein said polyelectrolyte is of the formula

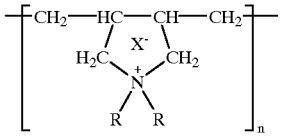

wherein R is alkyl, and n represents the number of segments, and wherein X is an anion.

15. A process in accordance with claim 14 wherein $X^-$ is a halide.

16. A process in accordance with claim 14 wherein R is alkyl.

17. A process in accordance with claim 14 wherein R is alkyl of methyl, ethyl or butyl.

18. A process in accordance with claim 14 wherein X is chloride, bromide or acetate.

19. A process in accordance with claim 14 wherein n is a number of from about 10 to about 200.

20. A surfactant free process for the preparation of toner consisting essentially of heating a mixture of a latex, a colorant, and a polyelectrolyte, wherein said polyelectrolyte and said heating enables aggregation and coalescence of said colorant and resin or polymer contained in said latex, and thereafter optionally cooling and isolating the toner formed, and wherein the resin or polymer is a sulfonated polyester.

21. A process for the preparation of toner compositions comprising (i) preparing an emulsion latex comprised of sulfonated polyester resin particles of from about 5 to about 300 nanometers in size diameter by heating said resin in water at a temperature of from about 60° C. to about 95° C.;

(ii) adding with shearing to said latex a colorant dispersion containing from about 20 to about 50 percent of colorant in water and with a mean colorant size range of from about 50 to about 150 nanometers, followed by the addition of a polyelectrolyte;

(iii) heating the resulting mixture at a temperature of from about 45° C. to about 65° C. thereby causing aggregation and enabling coalescence, resulting in toner particles of from about 2 to about 20 microns in volume average diameter; and (iv) cooling the toner product mixture followed by isolation, and drying.

22. A process in accordance with claim 21 wherein said shearing is accomplished by homogenizing at from about 1,000 revolutions per minute to about 10,000 revolutions per minute, at a temperature of from about 25° C. to about 35° C., and for a duration of from about 1 minute to about 120 minutes.

23. A process in accordance with claim 21 wherein the polyester of (i) is a polyester of poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalate phthalate), copoly(1,2-propylene-diethylene sodio 5-sulfoisophthalate)-copoly-(1,2-propylene-diethylene-terephthalate phthalate), copoly-(ethylene-neopentylene-sodio 5-sulfoisophthalate)-copoly-(ethylene-neopentylene-terephthalate-phthalate), or copoly(propoxylated bisphenol A)-copoly-(propoxylated bisphenol A-sodio 5-sulfoisophthalate).

24. A process in accordance with claim 21 wherein the polyelectrolyte is poly(diallyidimethyl ammonium) chloride or poly(diallyldiethyl ammonium) bromide.

25. A surfactant free process for the preparation of toner comprising admixing an emulsion latex comprised of sulfonated polyester resin particles with a colorant dispersion, and a polyelectrolyte or polyelectrolytes and heating the resulting mixture; and optionally cooling the mixture, wherein said polyelectrolyte or polyelectrolytes and said heating enables aggregation and coalescence of said colorant dispersion and said resin contained in said latex.

26. A process in accordance with claim 25 wherein said emulsion latex comprised of sulfonated polyester resin particles is generated by heating said resin particles in water at a temperature of from about 15° C. to about 30° C. above the polyester resin glass transition temperature, wherein said colorant dispersion contains from about 20 to about 50 percent of predispersed colorant in water, followed by the addition of said polyelectrolyte; heating the resulting mixture at a temperature of from about 35° C. to about 65° C. thereby causing aggregation and coalescence of resin and colorant; and cooling the resulting mixture.

27. A process in accordance with claim 25 wherein there is prepared an emulsion latex comprised of sodio sulfonated polyester resin particles by heating said resin in water, and subsequent to cooling the toner is isolated and then dried.

28. A process in accordance with claim 27 wherein isolation is by filtration and cooling is to about 25° C. to about 30° C.

* * * * *